United States Patent [19]

Revlett

[11] Patent Number: 4,745,656

[45] Date of Patent: May 24, 1988

[54] REFRIGERATOR CABINET DOOR HANDLE

[75] Inventor: Johnny R. Revlett, Henderson, Ky.

[73] Assignee: Whirlpool Corporation, Benton Harbor, Mich.

[21] Appl. No.: 940,117

[22] Filed: Dec. 10, 1986

[51] Int. Cl.[4] ..... E05B 1/00; A47B 95/02; B65D 25/28

[52] U.S. Cl. ..... 16/110 R; 16/111 R; 16/125; 16/DIG. 19; 74/558.5

[58] Field of Search ..... 16/110 R, 111 R, 114 R, 16/125, 116 R, DIG. 19, DIG. 5; 49/460; 312/214, 244, 320; 74/543, 558.5

[56] References Cited

U.S. PATENT DOCUMENTS

| | | | |
|---|---|---|---|
| 802,664 | 10/1905 | Schulz . | |
| 1,286,744 | 12/1918 | Otte | 16/110 R |
| 2,048,735 | 7/1936 | Erickson | 16/DIG. 5 |
| 2,078,478 | 4/1937 | Allen | 16/DIG. 5 |
| 2,103,743 | 12/1937 | Doty . | |
| 2,157,251 | 5/1939 | Tinnerman | 16/125 |
| 2,234,097 | 3/1941 | Tinnerman | 16/125 |
| 2,239,798 | 4/1941 | Tinnerman | 16/125 |
| 2,472,479 | 6/1949 | Hoff | 16/110 R |
| 2,486,557 | 11/1949 | Flora | 16/110 R |
| 2,653,686 | 9/1953 | Routt . | |
| 3,426,385 | 2/1969 | Gutshall | 16/125 |
| 3,648,411 | 3/1972 | Saunders et al. | 49/460 |
| 3,692,155 | 9/1972 | Laurita | 16/110 R |
| 3,766,598 | 10/1973 | Roberts | 16/125 |
| 3,995,349 | 12/1976 | Roberts et al. | 49/460 |
| 4,019,221 | 4/1977 | Baumgarten | 16/114 A |
| 4,039,099 | 8/1977 | Boxall | 16/114 R |
| 4,087,141 | 5/1978 | Roberts | 16/110 R |
| 4,575,897 | 3/1986 | Fischbach | 16/DIG. 24 |

*Primary Examiner*—Nicholas P. Godici
*Assistant Examiner*—Samuel M. Heinrich
*Attorney, Agent, or Firm*—Wood, Dalton, Phillips, Mason & Rowe

[57] ABSTRACT

A door handle for a refrigerator has a contoured base member of die cast construction. A longitudinal channel is included in a front portion of the base member. An elongated decorative insert is nested in the channel. Flexible spring clips are staked to stud members integrally cast in the base member and coact with locking tabs on the insert to retain the insert in association with the die cast base. Steel extension base pieces are utilized where a longer than normal door handle assembly is required.

15 Claims, 1 Drawing Sheet

FIG. 1
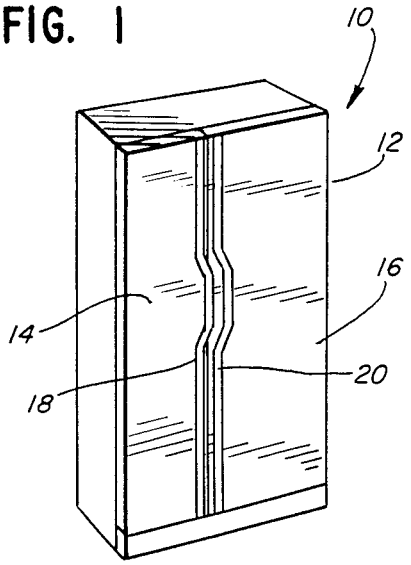
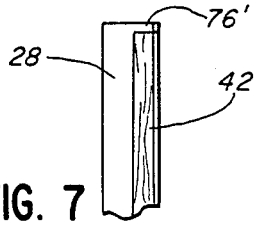
FIG. 7
FIG. 3
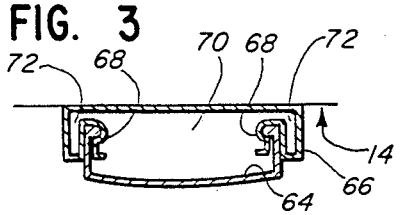
FIG. 4
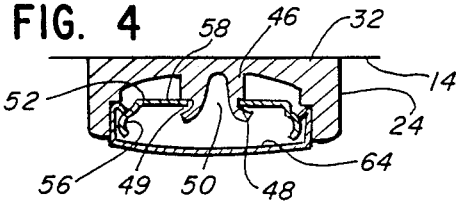
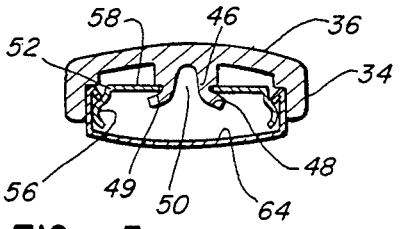
FIG. 5
FIG. 2
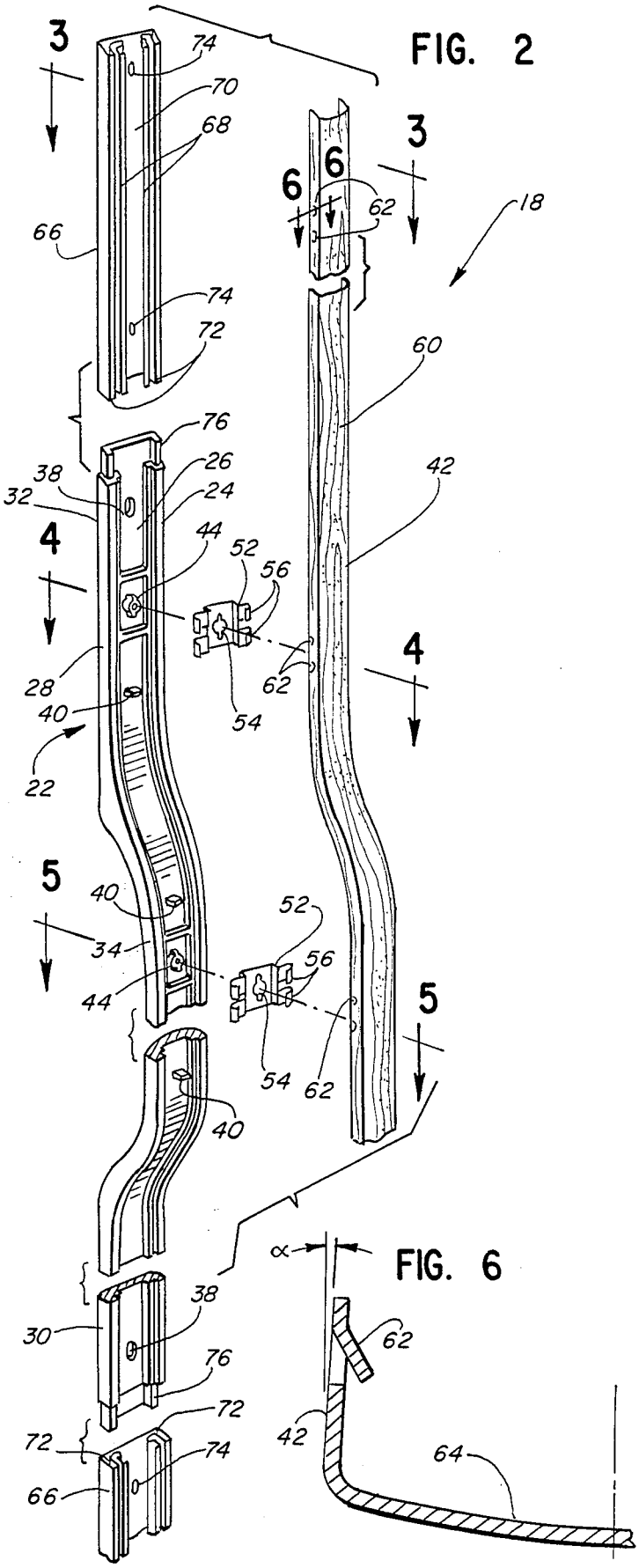
FIG. 6

REFRIGERATOR CABINET DOOR HANDLE

BACKGROUND OF THE INVENTION

1. Field of the Invention

This invention relates generally to handles, and more particularly, to an improved door handle for a refrigerator cabinet.

2. Description of the Background Art

Conventional door handles for refrigerator cabinets include a base portion and a decorative insert. One such handle is described in Roberts U.S. Pat. No. 4,087,141. The door handle described therein includes a pair of mounting brackets and an elongated extruded aluminum bar. A decorative insert having a wood grain vinyl cover snaps over the bar. Such an arrangement is disadvantageous in that the bar must be a straight extruded member, therefore requiring the bar to be spaced from the refrigerator cabinet door over its entire length.

For aesthetic reasons it is desirable to provide a contoured handle with only a portion of the handle being spaced from the cabinet door while the remaining portions of the handle directly abut the door.

It is known to provide such a contoured refrigerator door handle with a handle base formed of plastic or cold rolled steel. Such a handle base can be easily molded or formed to most any desirable shape. A decorative plastic or steel insert having a vinyl cover thereon is then placed over the handle base. The use of such an insert permits the appearance of the door handles on different refrigerators to be readily varied. It is necessary in such a construction to utilize steel or plastic in the base to provide grooves or channels within which a the insert can snap into place. Alternatively, end caps must be provided to retain the insert and handle base in assembled relation. However, the use of steel or plastic for the handle base results in a door handle which is undesirably flexible in nature. When an individual pulls on the handle to open the door, there will be some "give" in the handle due to the flexible nature of the handle base.

The present invention overcomes these and other problems of prior refrigerator cabinet door handles, in a novel and simple manner.

SUMMARY OF THE INVENTION

In accordance with the present invention, a door handle is provided for a refrigerator cabinet which may be readily assembled in a novel and simple manner, is aesthetically pleasing and provides a solid feel.

There is disclosed herein a novel refrigerator door handle. An elongated base member defines a front face and has a longitudinal channel opening through the front face. An elongated insert covers the channel. Clip means are secured to both the base member and the insert to retain the insert in association with the base member.

In the preferred embodiment, the elongated member is of die cast construction having a front channel formed therein. Openings are provided for securing the base to a refrigerator door. The base may be secured using screws or adhesives or any other known means.

A plurality of hollow studs extend outwardly from within the channel. Metallic clips include a central opening corresponding to the shape of the studs. The clips are inserted in the channel with the studs extending through the opening and thereafter the ends of the studs are flared so that the clips are retained thereon.

The insert includes a plurality of notches spaced according to the location of the clips. When the insert is placed over the channel and a force is applied thereon, the clips and notches coact to maintain the insert and base in assembled relation to provide a completed door handle.

An additional feature of the present invention is the use of extension channels formed of steel which may be fitted over either or both ends of the cast handle in order to provide an extended handle length. Such an extension may be provided with tabs or lugs to coact with notches on the insert so that the above-described clips are not required to be utilized in association with the extension channel.

Another feature of the present invention is the use of a handle base wherein the handle is further contoured and includes a rear face which is essentially flat at those portions which will be in contact with the refrigerator door, and which are rounded at raised portions which will be grasped by an individual when opening the door.

Further features and advantages of the invention will readily be apparent from the specification and from the drawings.

BRIEF DESCRIPTION OF THE DRAWINGS

FIG. 1 is a perspective view of a refrigerator cabinet having the door handle embodying the invention;

FIG. 2 is an exploded view of a door handle embodying the invention;

FIG. 3 is a sectional view taken along the lines 3—3 of FIG. 2;

FIG. 4 is a sectional view taken along the lines 4—4 of FIG. 2;

FIG. 5 is a sectional view taken along the lines 5—5 of FIG. 2;

FIG. 6 is a sectional view taken along the lines 6—6 of FIG. 2; and

FIG. 7 is a partial elevational view of an alternate embodiment of the invention

DETAILED DESCRIPTION OF THE PREFERRED EMBODIMENT

Referring to FIG. 1, a refrigeration apparatus, such as a refrigerator/freezer 10 includes a door handle according to the present invention. The invention is shown utilized with a side-by-side refrigerator/freezer; however, other types of refrigeration apparatus may be used in conjunction with the door handle of the present invention, as will be obvious to those skilled in the art.

The refrigerator/freezer 10 includes a cabinet 12 defining a below-freezing, or freezer compartment and a fresh fruit, or above-freezing compartment (not shown). A freezer door 14 and fresh food compartment door 16 are provided for selective access to the freezer and food compartments, respectively.

The freezer door 14 has a door handle 18. The fresh food compartment door 16 has a door handle 20. The two handles 18 and 20 are substantially identical and, therefore, only the freezer door handle 18 will be discussed in detail.

The door handle 18 is illustrated in greater detail in FIGS. 2–6. FIG. 2 illustrates the door handle 18 in an exploded fashion. FIGS. 3–6 illustrate various sectional views of the door handle 18.

Door handle 18 includes a contoured base member 22. The base member 22 is of die cast construction and may be, for example, zinc. Such a die cast construction is preferred to provide a door handle that is relatively inflexible so that it provides a "solid feel". The base member 22 is chrome plated for aesthetic reasons. The base member 22 defines a front face 24. A longitudinal channel 26 opens through the front face 24 into the base member 22.

The base member 22 includes first and second end portions 28 and 30. Each end portion 28 and 30 defines a planar rear face 32. The rear face 32 acts as a bearing surface where the base member 22 abuts the door 14. The base member 22 also includes a raised mid-portion 34. The mid-portion 34 is in spaced relationship with the door 14. A rear face 36 of the mid-portion 34 is rounded to provide a comfortable gripping surface for an individual opening the door 14.

The base member 22 includes a plurality of apertures 38. Screws (not shown) may be inserted through the aperture 38 to secure the base member 22 to the door 14. Alternatively, an appropriate adhesive could be utilized in place of screws. A plurality of tabs 40 extend outwardly from the channel 26. The height of the tabs is determined according to the shape of an insert 42, which is discussed in greater detail below.

Also included within the channel 26 are a plurality of hollow studs 44. Each stud 44 defines a hollow central area 50, has a base portion 46, and a narrower distal portion 48 defining a ridge 49. A plurality of clips 52 are provided, one for each stud 44. The clips 52 are of a flexible metal and include a central opening 54 corresponding in shape and size to the distal end 48 of the studs 44. The clips 52 include formed S-shaped lateral edges 56. Each clip 52 is placed on its associated stud 44 with the distal end 48 thereof extending through the central opening 54 of the clip 52. A bottom surface 58 of the clip 52 rests on the ridge 49. The stud 44 is then staked to flare out the distal end portion 48 to retain the clip 52 thereon. The clip 52 is shown staked on the stud 44 in greater detail in FIGS. 4 and 5.

In the preferred embodiment, an insert 42 is of channel configuration, formed of steel or plastic with a decorative vinyl covering 60 applied thereon. The vinyl covering 60 may provide, for example, a woodgrain look. The insert 42 is elongated and has a longitudinal shape corresponding to the longitudinal shape of the base member 22. The insert 42 has a plurality of locking tabs 62 along its lateral edges for mating with edges 56 of clips 52 to maintain the insert 42 and the base member 22 in assembled relationship. The locking tabs are shown in greater detail in FIG. 6. The insert nests within the channel 26 of the base member 22 with an inner surface 64 of the insert resting against the tabs 40 to maintain appropriate spacing.

With die cast products, it is expensive to cast relatively long articles. Therefore, it is desirable to minimize the length of the cast base member 22. Where the door handle extends from the top to the bottom of a refrigerator, as illustrated in FIG. 1, extension base channel members 66 are provided. The extension members 66 may be utilized both as an upper and lower extension of the base member 22. The exact length of any such extension members 66 is determined according to the dimensions of the cabinet 12.

The extension members 66 are manufactured of formed, cold rolled steel. The cross section of the extension members 66 is shown in greater detail in FIG. 3. The extension member 66 includes a pair of oppositely facing S-shaped end portions 68 defining a central channel 70 therebetween and end channels 72. The extension member 66 includes appropriate apertures 74 for securing the extension member to the door 14. To maintain the extension member 66 in assembled relation with the cast base member 22, the cast base member 22 is provided with an end portion 76 of a size and shape to fit within the end channels 72 of the extension member 66. The extension member 66 is slidably mounted on the end portion 76 so that it is linear association with the base member 22.

The locking tabs 62 on the insert 42 coact with the S-shaped portions 68 of the extension member 66 so that the insert 42 is nested within the extension member channel 70 and is maintained in assembled relation therewith. The S-shaped ends 68 function in much the same manner as the clips 52 previously discussed.

Either the insert 42 or the clips 52 and the extension base members 66 must be formed of a flexible material so that the insert 42 may be readily snapped into place to cover the channels 26 and 70 without damaging any of the parts.

Where extension base members 66 are not utilized, the cast base member 22 will be cast with a cap portion 76' as is shown in FIG. 7. The cap portion 76' is of a height slightly greater than the height of the insert 42 when it is nested in the base member 22.

Thus, the invention thoroughly comprehends a readily assemblable, sturdy refrigerator door handle which provides a solid feel to an individual grasping same to open the door. The solid feel is contributed by a metal die cast base member. Because of the high temperatures and pressures involved in casting a metal member, the member is cast in a simple mold without the use of articulated mold sections. Because an articulated mold is needed to provide undercut grooves in a cast member, no such grooves, to which the insert may be snap-fitted, can be provided in a metal die cast base member. The present invention resolves this vexation problem by providing stud members integrally cast into the base member and a suitably formed resilient clip staked to the stud as a means to capture locking tabs on the insert.

The foregoing disclosure of the preferred embodiment is illustrative of the broad inventive concepts comprehended by the invention.

I claim:

1. A refrigeration apparatus door handle comprising:

an elongated contoured base member of cast construction defining a front face and having a longitudinal channel opening through said front face;

first securing means for securing said member to a door of a refrigerator apparatus;

an elongated insert for covering said channel;

clip means;

second securing means for securing said clip means within said longitudinal channel; and third securing means for flexibly securing said insert to said clip means in a snap-fit manner as the sole securing means to retain said insert in association with said elongated member.

2. A refrigeration apparatus door handle comprising:

an elongated base member defining a front face and having a longitudinal channel opening through said front face;

first securing means for securing said member to a door of a refrigeration apparatus;

an elongated insert for covering said channel;

clip means;

second securing means for securing said clip means within said longitudinal channel, wherein said second securing means comprises a plurality of studs disposed within said longitudinal channel; and third securing means for securing said insert to said clip means to retain said insert in association with said elongated member.

3. The door handle according to claim 2 wherein said clip means comprises a plurality of flexible clips each having a central aperture.

4. The door handle according to claim 3 wherein said studs extend through said apertures and include a flared distal end to retain said clips thereon.

5. A refrigeration apparatus door handle comprising:

an elongated base member defining a front face and having a longitudinal channel opening through said front face;

first securing means for securing said member to a door of a refrigeration apparatus;

an elongated insert for covering said channel, said insert including flexible locking tabs formed thereon;

clip means;

second securing means for securing said clip means within said longitudinal channel; and third securing means for securing said insert to said clip means wherein said third securing means includes said locking tabs coacting with said clip means to retain said insert in association with said base member.

6. A door handle for a refrigeration apparatus comprising:

a cast elongated base member defining a longitudinal front-facing channel and including a plurality of outwardly extending studs disposed within said channel;

first securing means for securing said base member to a door of said refrigeration apparatus;

an elongated insert of channel configuration for covering said channel;

a plurality of clips, each said clip having a central aperture through which one each of said studs extends;

staking means for staking said clips to said studs within said longitudinal channel; and securing means to retain said insert in association with said elongated member.

7. The door handle according to claim 6 wherein said staking means comprises a distal end of said studs being flared to retain said clips thereon.

8. A door handle for a refrigeration apparatus comprising:

a cast elongated base member defining a longitudinal front-facing channel;

first securing means for securing said base member to a door of said refrigeration apparatus;

an elongated insert of channel configuration for covering said channel said insert including flexible locking tabs formed thereon;

clip means;

staking means for staking said clip means within said longitudinal channel; and second means for securing said insert to said clip means to retain said insert nested within said channel, wherein second securing means comprises said locking tabs coacting with said clip means to retain said insert in association with said base member.

9. A refrigerator door handle comprising:

an elongated base member of die cast construction defining a front face and having a longitudinal channel opening through said front face, said base member also defining a rear face;

said base member including a first portion wherein said rear face of said first portion abuts a refrigerator door, and a second portion wherein said rear face of said second portion is in spaced relation with the refrigerator door;

first securing means for securing said handle at said first portion to the refrigerator door;

an elongated insert of channel configuration for covering said longitudinal channel;

a plurality of flexible clips having central apurtures therein;

a plurality of hollow studs, disposed within said longitudinal channel said studs extending through said apertures of said clips wherein a distal end of each stud is flared to retain said clips thereon; and said insert including a plurality of locking tabs for securing said insert to said clips to retain said insert in association with said base member.

10. The door handle according to claim 9 wherein said rear face of said first portion defines a planar surface.

11. The door handle according to claim 9 wherein said rear face of said second portion defines a rounded surface.

12. The door handle according to claim 9 further comprising an extension base member, said extension base member including second securing means for securing said extension base member to the refrigerator door in linear association with said elongated base member first portion.

13. The door handle according to claim 12 wherein said extension base member includes formed lateral edges which coact with said locking tabs to secure said insert to said extension base member.

14. A refrigeration apparatus door handle comprising:

an elongated base member defining a front face and having a longitudinal channel opening through said front face, said channel including opposed sidewalls;

first securing means for securing said member to a door of a refrigeration apparatus;

an elongated insert for covering said channel, said insert including a plurality of enlarged edge portions;

a plurality of clips, each clip having opposed lateral edges; and second means for securing said clips within said longitudinal channel and defining a spacing between said lateral edges and said channel side walls less than the size of said enlarged edge portions of said inserts, wherein the lateral edges of said clips interlock with the enlarged edge portions of said insert and said channel side walls to positively retain said insert within said channel.

15. The door handle of claim 14 wherein each said clip includes a pair of longitudinally spaced lateral edge portions for engaging said insert.

* * * * *